US006186360B1

(12) United States Patent
Becker et al.

(10) Patent No.: US 6,186,360 B1
(45) Date of Patent: Feb. 13, 2001

(54) MACHINE AND METHOD FOR UNLOADING A BULK-MATERIAL BAG

(75) Inventors: Steven L. Becker, Edgerton; Thomas G. Kelly, Delavan; Jeffrey M. Nauman, Janesville, all of WI (US)

(73) Assignee: Schenck AccuRate, Inc., Whitewater, WI (US)

( * ) Notice: Under 35 U.S.C. 154(b), the term of this patent shall be extended for 0 days.

(21) Appl. No.: 09/196,592

(22) Filed: Nov. 20, 1998

(51) Int. Cl.[7] ..... B67B 7/00; B76D 5/06

(52) U.S. Cl. ..... 222/1; 222/181.2; 222/203

(58) Field of Search ..... 222/1, 180, 181.1, 222/181.2, 185.1, 173, 52, 64, 92, 95, 97, 103, 202, 203

(56) References Cited

U.S. PATENT DOCUMENTS

| | | | | |
|---|---|---|---|---|
| 2,858,051 | * | 10/1958 | Cunningham | 222/103 |
| 3,804,298 | | 4/1974 | Ricciardi | 222/56 |
| 4,378,897 | | 4/1983 | Kattelmann | 222/56 |
| 4,810,156 | | 3/1989 | Pendleton et al. | 414/415 |
| 4,983,090 | | 1/1991 | Lehmann et al. | 414/326 |
| 5,103,401 | | 4/1992 | Johnson | 364/479 |
| 5,141,135 | | 8/1992 | Volk, Jr. | 222/105 |
| 5,423,455 | | 6/1995 | Ricciardi et al. | 222/1 |
| 5,450,984 | | 9/1995 | Rohr | 222/56 |
| 5,692,868 | | 12/1997 | Riemersma | 414/403 |
| 5,699,730 | * | 12/1997 | Ogier et al. | 222/181.2 X |
| 5,788,449 | * | 8/1998 | Riemersma | 222/103 X |

* cited by examiner

*Primary Examiner*—Andres Kashnikow
*Assistant Examiner*—Jorge S. Bocanegra
(74) *Attorney, Agent, or Firm*—Jansson, Shupe, Bridge & Munger, Ltd.

(57) ABSTRACT

Disclosed is a machine for unloading a bulk-material bag of the type having a bottom portion, a side portion and a transition portion between the bottom and side portions. The machine includes an apparatus aiding discharge of the material from the bag. In the improvement, the apparatus includes a tri-section panel mounted for movement on the machine, thereby configuring the panel to sequentially contact the bottom, transition and side portions of the bag. The panel has first, second and third segments angle-mounted to one another. In a specific embodiment, the segments are substantially planar. A microprocessor-based controller is coupled to the actuator and regulates its movement as a function of a process parameter, e.g., the compressibility of the bag and/or the weight of the material contained in the bag. A highly preferred embodiment of the machine also has a bag lifting mechanism above the tri-section panel. Such mechanism includes an extensible device coupled to the controller for regulating extension of such device as a function of the weight, volume or level of the material contained in the bag. A new method for unloading a bulk material bag is also disclosed.

40 Claims, 10 Drawing Sheets

MACHINE AND METHOD FOR UNLOADING A BULK-MATERIAL BAG

FIELD OF THE INVENTION

This invention relates generally to bulk material handling and, more particularly, to apparatus for emptying portable receptacles, e.g., flaccid/limp/soft-sided bags, by "jarring" or "working" them.

BACKGROUND OF THE INVENTION

Many types of dry, finely-divided (i.e., powdered or powder-like) materials, e.g., flour, rice hulls, pharmaceuticals, plastic, colorant, cement among many, many others, are shipped to a point of usage using large, soft-sided, reusable bags. Such bags, commonly cubic, have a top fill opening and a bottom spout and after being emptied, the soft bags may be collapsed to but a fraction of their filled volume for return to a filling site.

At the point of usage, such bags are mounted one-at-a-time on a machine of the type generally known as a bag unloader or bag frame. There, the contents of the bag are emptied through the spout for, e.g., repackaging into retail containers, compacting into tablet form, mixing with other constituents or for other, further processing. A representative list of companies selling (or which have sold) bag unloading equipment includes National Bulk Equipment, Inc. (NBE), Holland, Mich.; Vac-U-Max, Belleville, N.J.; and Beta Raven, Inc. of Earth City, Mo. And Schenck AccuRate, Inc., Whitewater, Wis., is a leading manufacturer of such equipment.

A characteristic of bag-confined, finely-divided or powdered materials is that when the bag is full or nearly so and the spout is opened for material discharge, the material tends to "bridge," i.e., to repose in an arch-like formation. While such formation is structurally quite weak, it is sufficient to impede material flow. Similarly, such materials may "rat hole," i.e., may flow from the spout in such a way that a downwardly extending hole forms. This, too, impedes material flow.

This characteristic of dry powder materials has long been recognized and steps have been taken to prevent such bridging and rat holing. NBE uses a pair of double-faced paddles moved by a common cylinder to agitate the powder in a bag. NBE literature indicates this arrangement is to promote powder flow if bagged material becomes packed during transportation or storage. Another arrangement available from NBE involves arm-mounted hammers which periodically strike the sides of the bag.

Another aspect of prior art involves what is often referred to as a bag tensioning or bag lifting mechanism. One known type of such mechanism supports the bag using what are known as gas cylinders or, more typically, gas springs. (As an illustration, a gas spring is often used to automatically raise the rear hatch of a hatchback auto when unlatched.) The known type of mechanism uses four such gas springs.

While these prior art arrangements have been generally satisfactory for their intended purposes, they are not without disadvantages. As a general observation, such prior art arrangements seem not to optimally address the need to help assure smooth powder flow during all phases of bag emptying, i.e., at initial discharge, when the bag is about half empty and when the bag is nearly empty.

More specifically, known prior art arrangements do not optimally prevent close-to-the-spout material bridging at the onset of material flow from a fully-filled bag. Nor do such arrangements optimally prevent bridging and rat-holing well upward in the bag as emptying progresses. And such arrangements have not fully recognized how to deal with the tendency of material to lodge in the bag lower portions when the bag is nearly, but not entirely, empty.

A difficulty with the aforedescribed bag tensioning or bag lifting mechanism is that the gas springs sometimes tend to bind. And there is no opportunity to control operation by manipulating gas pressure; the gas spring is permanently sealed and, for a particular rod position, such pressure is fixed.

And aside from the matters of assuring smooth powder flow during all phases of bag emptying, prior art arrangements seem not to have appreciated how smooth, substantially bridge-free bag unloading can be improved by process control which changes the operation of a bag unloading machine as a function of the degree to which the bag is emptied.

An improved bag unloading machine and method which address these deficiencies perceived in prior art arrangements would be an important advance in this field of technology.

OBJECTS OF THE INVENTION

It is an object of the invention to overcome some of the problems and shortcomings of prior art arrangements.

Another object of the invention is to provide a new machine and method which help assure smooth powder flow at initial discharge from a full bag.

Another object of the invention is to provide a new machine and method which help assure smooth powder flow when the bag is only partially full.

Yet another object of the invention is to provide a new machine and method which help assure smooth powder flow when the bag is nearly empty.

Another object of the invention is to provide a new machine and method which involve monitoring of one or more process variables.

Still another object of the invention is to provide a new machine and method which change the operation of a bag unloading machine as a function of the degree to which the bag is emptied.

Another object of the invention is to provide a new machine and method which involve monitoring of one or more process variables.

Still another object of the invention is to provide a new machine and method which provide substantially bind-free operation of a bag tensioning mechanism and the opportunity for process-based control of such mechanism.

How these and other objects are accomplished will become apparent from the following descriptions and from the drawings.

SUMMARY OF THE INVENTION

Aspects of the invention involve improvements in a machine for unloading a bulk-material bag of the type having a bottom portion, a side portion and a transition portion between the bottom and side portions. In this specification, such side portion and transition portion are also referred to as the first side portion and the first transition portion, respectively. The machine has at least one apparatus aiding discharge of the material from the bag.

In the improvement, the apparatus includes a tri-section panel mounted for movement on the machine, thereby configuring the panel to contact the bottom, transition and side portions of the bag. The tri-section panel includes first, second and third segments and in a specific embodiment, the first and second segments are angle-mounted to one another and the second and third segments are angle-mounted to one another. More specifically, at least two (and, preferably, all three) of the first, second and third segments are substantially planar.

The tri-section panel has an actuator coupled to it at a pivot-type actuator joint. A pivot mount is also coupled to such panel at a location laterally spaced from the actuator joint. In a specific embodiment, the tri-section panel includes an inward edge and the pivot mount is coupled to the tri-section panel between the inward edge and the actuator joint.

Other features of the invention facilitate changing the operation of the bag unloading machine as a function of the degree to which the bag is emptied and the resulting compressibility of the bag. That is, a controller is coupled to the actuator and regulates its movement. In a specific embodiment where the actuator is a pneumatic cylinder, the controller regulates movement of the cylinder rod. But however such actuator is embodied, the controller regulates actuator movement as a function of bag/material compressibility.

Another aspect of the invention recognizes and deals with the propensity of powdered material to lodge in the bag lower portions when the bag is nearly, but not entirely, empty. In a highly preferred embodiment, the machine includes a bag lifting mechanism positioned above the tri-section panel and connected by hooks or the like to the top bag portion. The bag lifting mechanism includes an extensible device such as an exemplary air bladder. In a specific embodiment, there are three air bladders positioned and configured to apply lifting force to the bag when pressurized air is forced into such bladders. In an optional arrangement, the controller is indirectly coupled to the extensible device and regulates extension thereof as a function of the degree to which the bag is emptied. In a preferred embodiment, the machine includes a frame and the extensible device(s) coact between the frame and the lifting mechanism.

And while a machine with a single tri-section panel has significant utility, a highly preferred machine includes both first and second tri-section panels. The bag has the aforementioned first side and first transition portions, respectively, and also includes a second side portion and a second transition portion opposite the first side portion and the first transition portion, respectively. The machine includes a second tri-section panel mounted for movement on the machine, thereby configuring the second tri-section panel to contact the bottom portion, the second transition portion and the second side portions of the bag.

Most preferably, the first and second tri-section panels are opposite one another. Stating it another way, the first and second tri-section panels are coincident with a tri-panel axis which substantially bisects the bag laterally. In a highly preferred embodiment, the machine also includes a pair of passive support paddles pivot-mounted to be coincident with a support paddle axis generally perpendicular to the tri-panel axis. As further explained below, these support paddles reduce the distance through which the bag is required to be lifted when mounting it to or demounting it from the machine and help promote material flow.

Other aspects of the invention involve a method for unloading a bag containing bulk material and having a spout, and the bottom, side and transition portions mentioned above. The method includes providing a machine having a movable tri-section panel with first, second and third segments and suspending the bag so that its bottom, transition and side portions are proximate the first, second and third segments, respectively. The spout is opened to permit material to flow out of the bag and, sequentially, the first and second segments are urged against the bottom portion and the transition portion, respectively. This helps prevent bridging at the onset of material flow from a full bag.

More specifically, the first segment includes an inward edge toward the spout and a junction portion proximate the second segment and spaced from the inward edge. The urging step includes moving the tri-section panel so that the inward edge is above the junction portion. (The junction portion is so named because it is the portion which joins the first segment to the second segment.) In a preferred embodiment wherein the first segment is substantially planar, the urging step includes moving the tri-section panel so that the included angle between the first segment and a horizontal plane is in the range of 1° to 6° and, most preferably, is about 3°. This feature is a useful departure from known approaches in that it "pushes up" significantly on the bottom of the bag to discourage bridging.

And as noted previously, the invention enables controlling the machine and carrying out the method by monitoring a process parameter relating to the amount of material remaining in the bag. When the amount of material remaining in the bag becomes about equal to a predetermined amount, the method involves pushing against the transition portion and the side portion using the second and third segments sequentially. More particularly, the pushing step includes changing the operation of an actuator.

And changing the way the tri-section panel pushes against the bag is not the only event resulting from monitoring a process parameter. The method may also include elongating the bag when the amount of material remaining in the bag becomes about equal to a predetermined amount. Bag elongation is by the bag lifting mechanism and includes actuating the extensible device, e.g., the air bladder mentioned above, by delivering air into the bladder.

Further details of the invention are set forth in the following detailed descriptions and in the drawings.

BRIEF DESCRIPTIONS OF THE DRAWINGS

FIGS. 13, 14, 15 and 16 constitute a sequence representing the machine and the bag when the bag is substantially full to when the bag is about empty.

Figure 1:
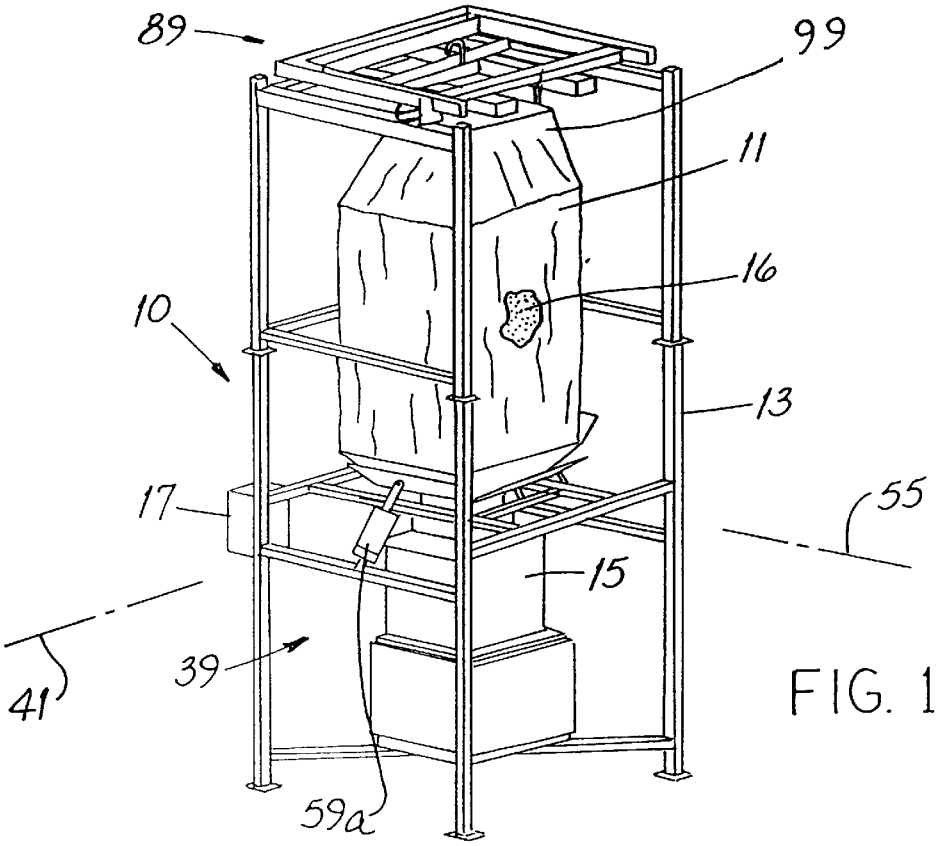
FIG. 1 is a perspective view of the new bag unloading machine (otherwise referred to as a "bag frame") shown in conjunction with a filled bag mounted thereon. A portion of the bag is broken away to represent the material in the bag.
Figure 2:
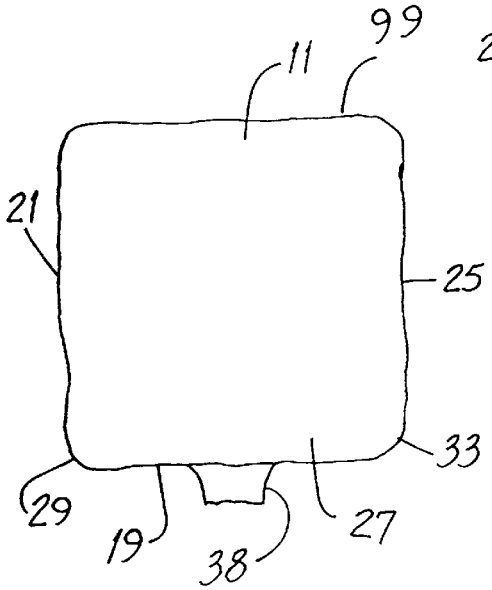
FIG. 2 is a side elevation view of a bag of the type to be unloaded using the machine of FIG. 1.
Figure 3:
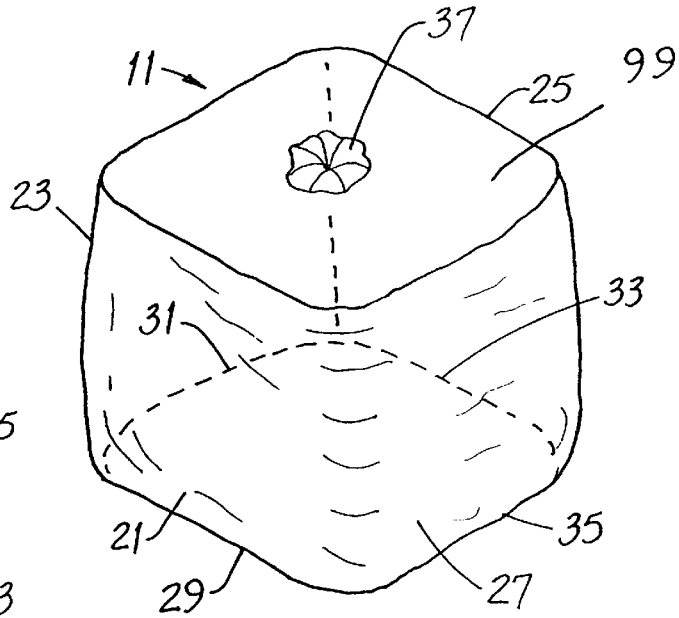
FIG. 3 is a perspective view of the bag of FIG. 2. Phantom surfaces are shown in dashed outline.
Figure 17:
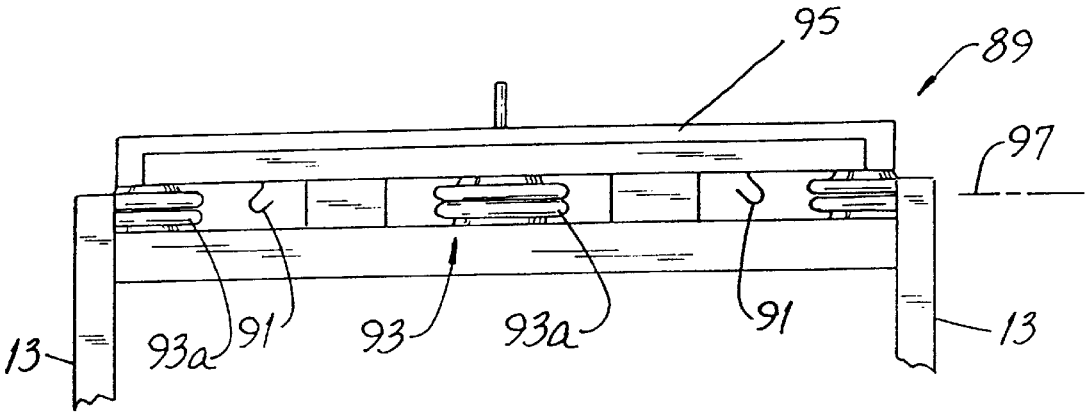

FIG. 17 is a representative side elevation view of a bag lifting mechanism which may be used with the machine of FIG. 1. The mechanism is in its "bag-lowered" position.

Figure 18:
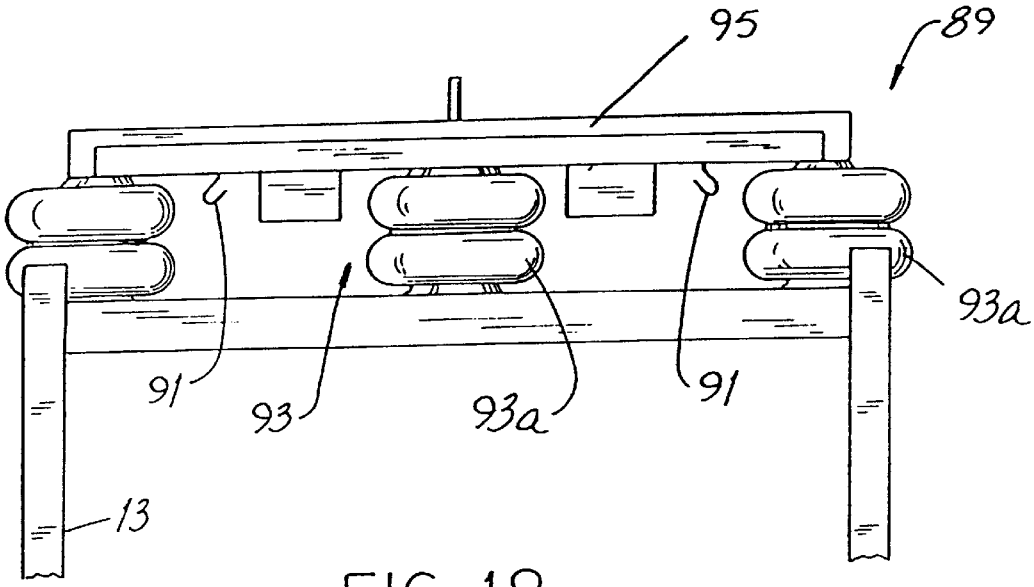

FIG. 18 is a representative side elevation view of the bag lifting mechanism of FIG. 17 in the "bag-hoisted" position.

Figure 19:
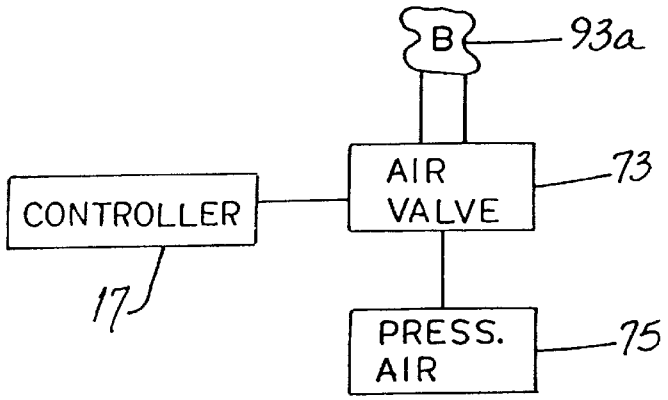

FIG. 19 is a representation of another embodiment of a controller/pneumatic circuit which may be used with the machine of FIG. 1.

Figure 20:
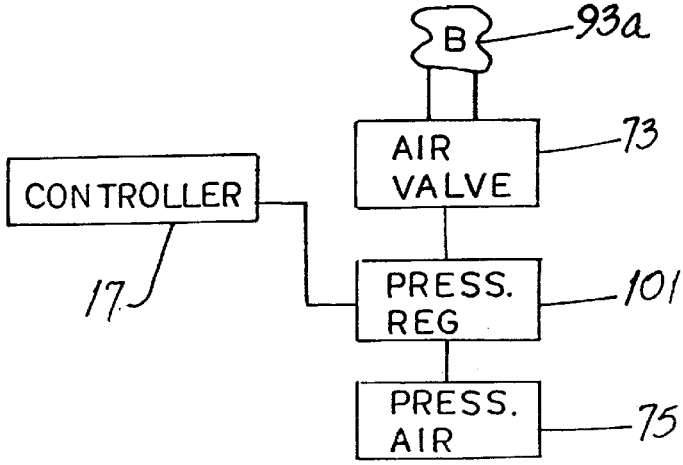

FIG. 20 is a representation of yet another embodiment of a controller/pneumatic circuit which may be used with the machine of FIG. 1.

Figure 21:
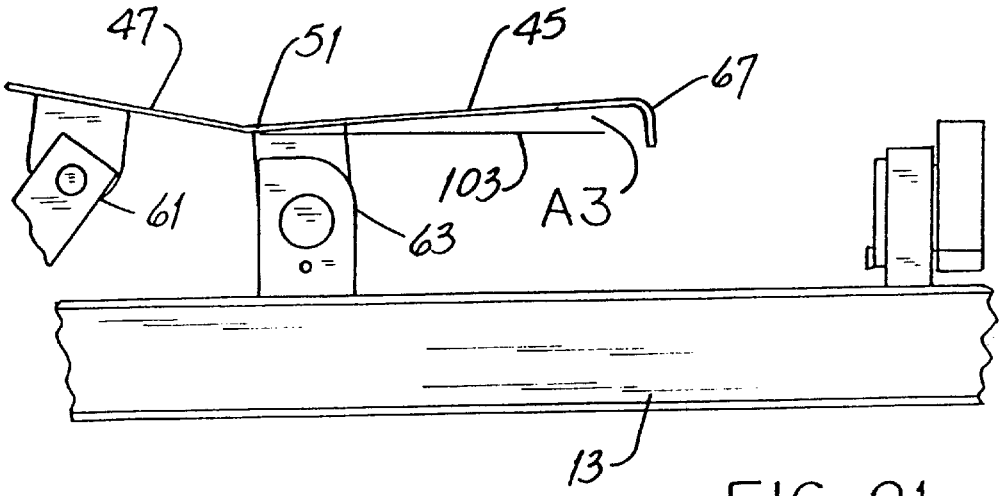

FIG. 21 is a side elevation view showing one of the tri-section panels in the bag "bottom lift" position used until the bag is well along to being empty. Parts are broken away.

Figure 22:
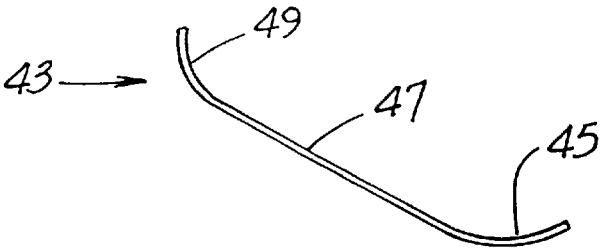

FIG. 22 is an elevation, i.e. edge, view of another embodiment of a tri-section panel used with the machine of FIG. 1.

Figure 23:
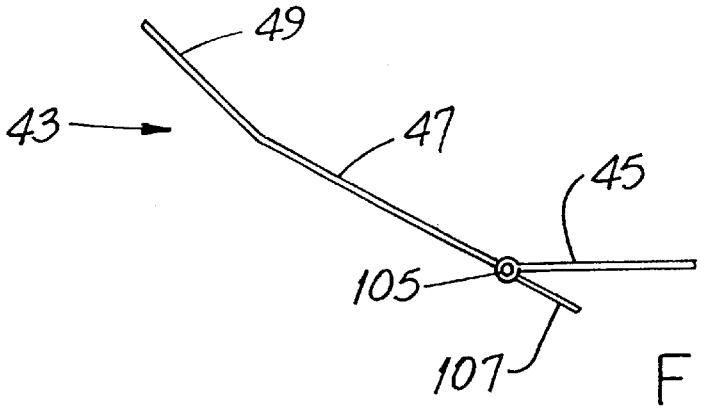

FIG. 23 is an elevation, i.e. edge, view of yet another embodiment of a tri-section panel used with the machine of FIG. 1.

DETAILED DESCRIPTIONS OF PREFERRED EMBODIMENTS

Referring to FIGS. 1, 2, 3 and 4, the invention involves improvements in a machine 10 for unloading a bulk-material bag 11. Exemplary materials, one of which might be contained in the bag 11 includes flour, rice hulls, pharmaceuticals, plastic, colorant and cement.

The machine 10 includes an upright, generally rectangular frame 13 having a receptacle 15 mounted in the lower portion thereof. Such receptacle 15 may be, for example, a screw feeder, a receiving hopper or the end of a weigh belt of the type which weighs the material thereon. A microprocessor-based process controller 17 is conveniently mounted on the frame 13.

An exemplary bag 11 is of the type having a bottom portion 19 and first, second, third and fourth side portions 21, 23, 25, 27, respectively. First, second, third and fourth transition portions 29, 31, 33, 35, respectively, extend between the bottom portion 19 and the correspondingly-numbered side portions. The bag 11 also includes a top fill port 37 and a bottom spout 38 for loading the material 16 into and unloading the material 16 from the bag 11, respectively.

Referring also to FIGS. 5, 6, 7 and 8, the machine 10 has at least one apparatus 39 aiding discharge of the material 16 from the bag 11. In a highly preferred embodiment, the machine 10 includes two such apparatus 39*a*, 39*b* lateral to one another (i.e., lateral to bear against the first and third side portions 21, 25, the first and third transition portions 29, 33, and the bag bottom portion 19) and coincident with a tri-panel axis 41 which substantially bisects the bag 11 laterally. Each apparatus 39 includes a tri-section panel 43*a*, 43*b* mounted for movement on the machine 10, thereby configuring the panels 43 and machine 10 to contact the bottom, transition and side portions 19, 29, 33, 21, 25, of the bag 11.

Each of the tri-section panels 43*a*, 43*b* includes first, second and third segments 45, 47, 49, respectively, and in a specific embodiment, the first and second segments 45, 47 are angle-mounted to one another at junctions 51. The included angle Al between the segments 45, 47 is preferably between about 155° and 175° and, most preferably, is about 166°.

Similarly, the second and third segments 47, 49 are angle-mounted to one another at junctions 51. The included angle A2 between the segments 47, 49 is preferably between about 130° and 170° and, most preferably, is about 150°. In a highly preferred embodiment, the first, second and third segments 45, 47, 49 are substantially planar.

Figure 4:
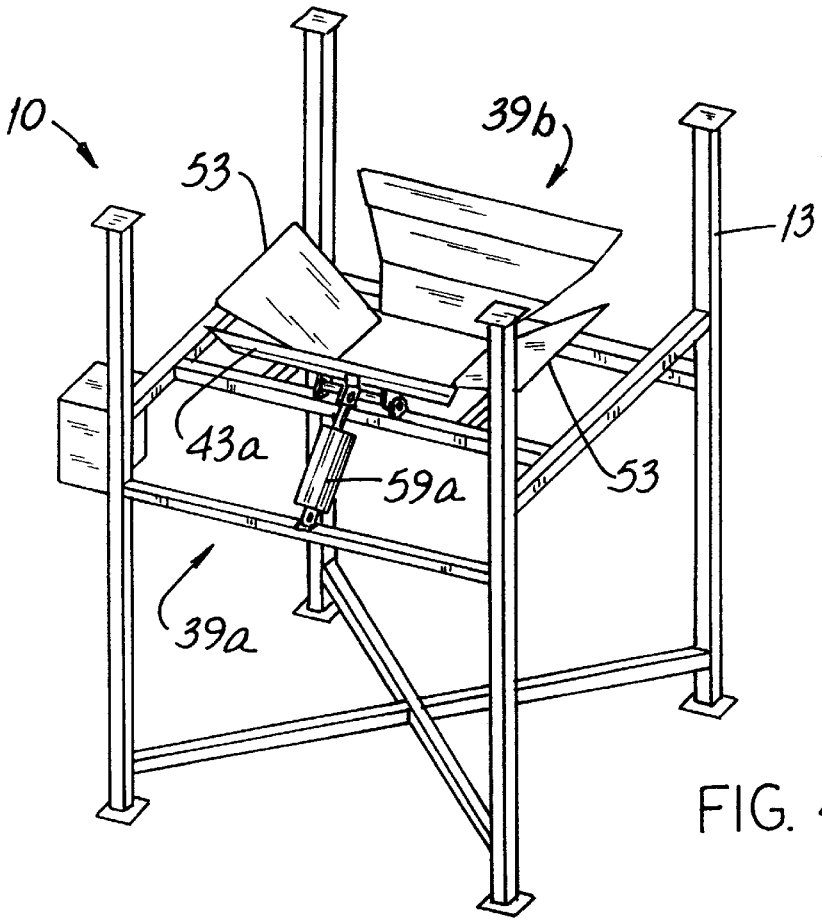
FIG. 4 is a perspective view of portions of the machine of FIG. 1. Parts are broken away.
Figure 9:
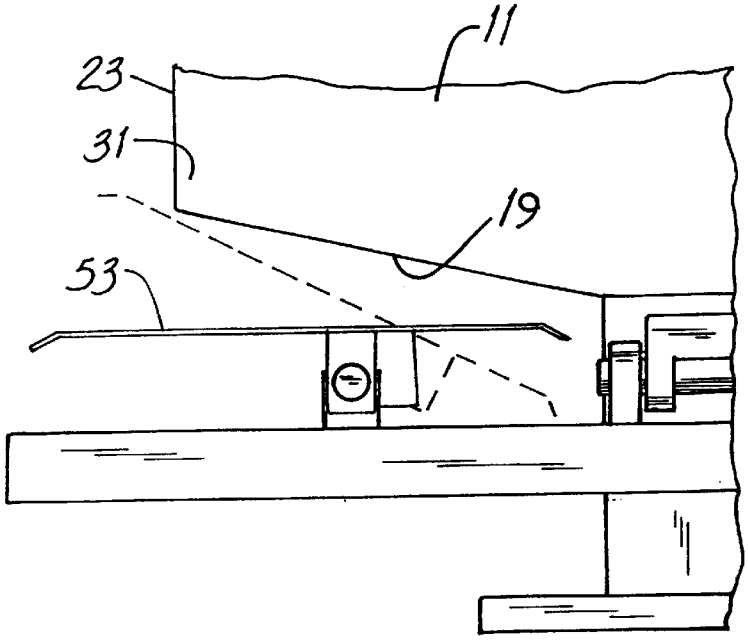
FIG. 9 is a representative side elevation view showing one of the passive support paddles of the machine of FIG. 1 in conjunction with a bag and the machine. Parts are broken away and a paddle position is shown in dashed line.
Figure 5:
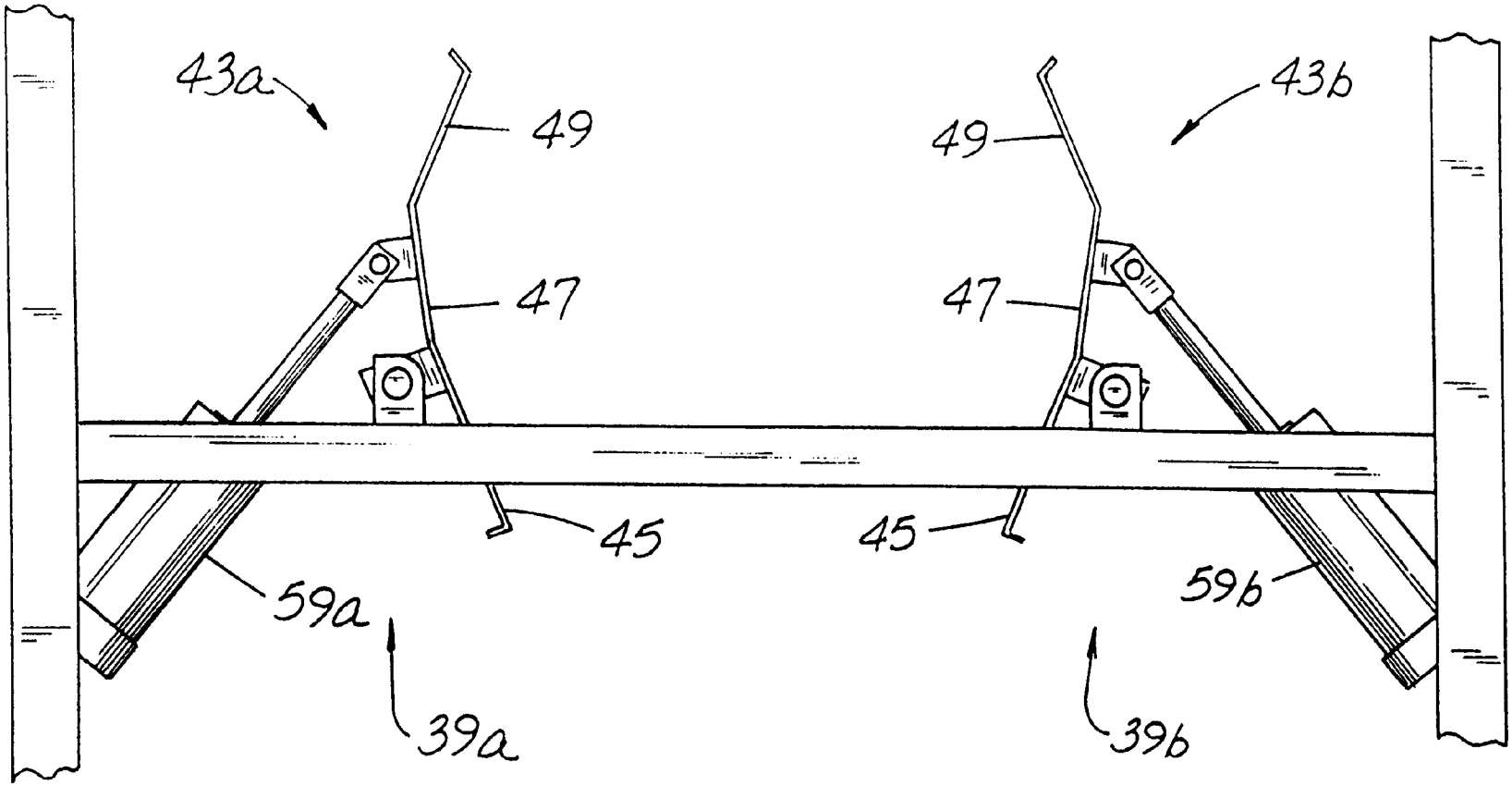
FIG. 5 is an elevation view of the apparatus having a pair of tri-section panels and actuators aiding discharge of the material from a bag. The panels are shown in positions they would assume when the bag is about empty.
Figure 6:
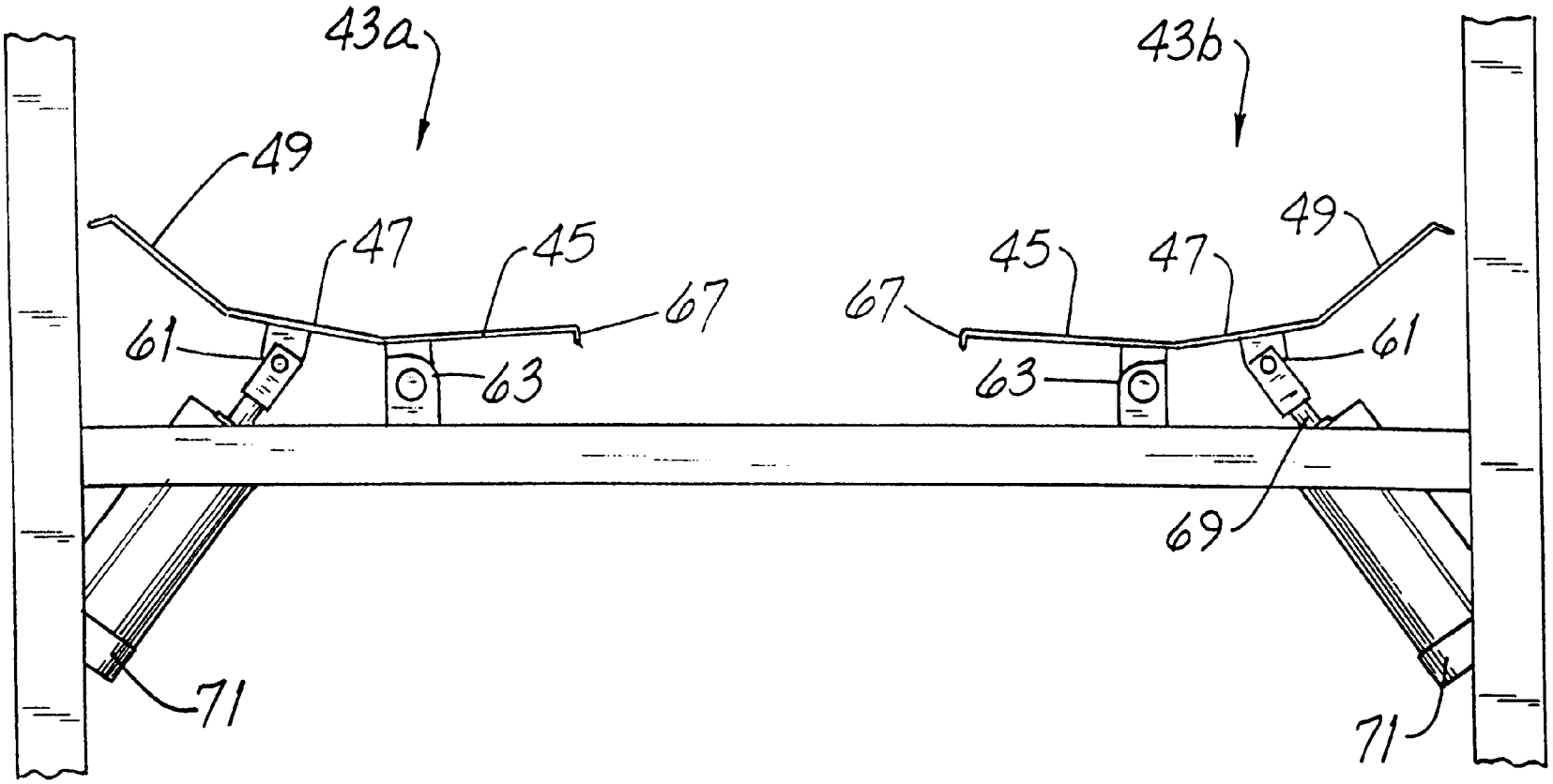
FIG. 6 is an elevation view of the apparatus of FIG. 5 with the panels shown in positions they would assume when the bag is, e.g., nearly full of material.
Figure 7:
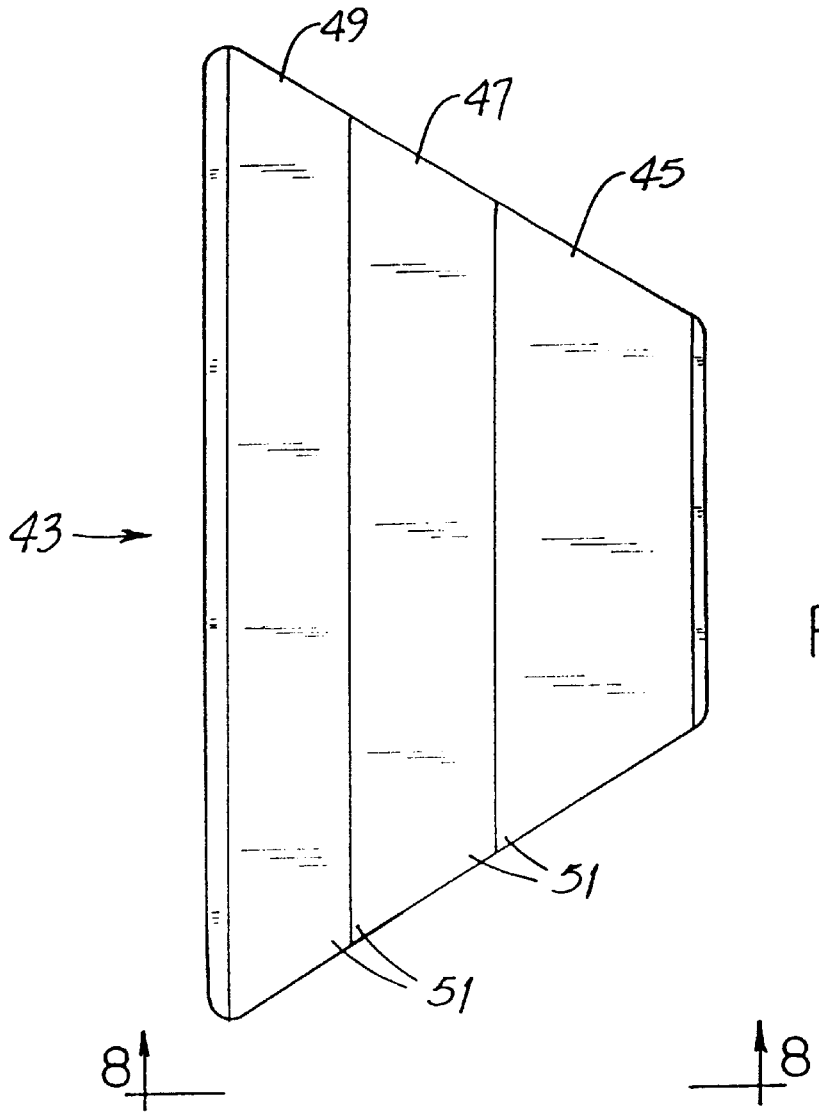
FIG. 7 is a top plan view of one of the tri-section panels shown in FIGS. 1, 2, 5 and 6.
Figure 8:
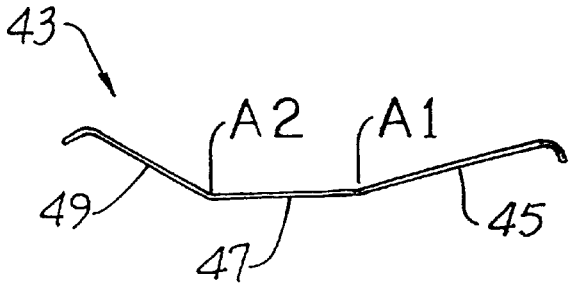
FIG. 8 is an elevation view of the tri-section panel of FIG. 7 taken along the viewing plane 8—8 thereof.

Referring to FIGS. 1, 4 and 9, a highly preferred embodiment of the machine 10 also includes a pair of passive support paddles 53 pivot-mounted opposite one another to be coincident with a support paddle axis 55 generally perpendicular to the tri-panel axis 41. When a full bag 11 is loaded on the machine 10, the paddles 53 tend to assume the position shown in solid line in FIG. 9. And as the bag 11 empties and is lifted away, such paddles 53 tend to assume the position shown in dashed line. These support paddles 53 reduce the distance through which the bag 11 is required to be lifted when mounting it to or demounting it from the machine 10 and help promote material flow. (The support paddles 53 are termed "passive" because in a highly preferred embodiment, there are no actuators attached thereto.)

Referring now to FIGS. 1 through 11, each tri-section panel 43*a*, 43*b* has a separate actuator 59*a*, 59*b* coupled to it at a pivot-type actuator joint 61. A pivot mount 63 is also coupled between a panel 43 and the frame 13 at a location laterally spaced from the actuator joint 61. In a specific embodiment, the tri-section panel 43 includes an inward edge 67 and the pivot mount 63 is coupled to the tri-section panel 43 between the inward edge 67 and the actuator joint 61. In a specific embodiment, the actuators 59*a*, 59*b* are pneumatic cylinders, the rod 69 of which is attached at the joint 61 and the head end 71 of which is anchored to the frame 13. (After appreciating the specification, one of ordinary skill will recognize that hydraulic or electric actuators could also be used.)

In the preferred arrangement shown in FIGS. 1, 4, 5 and 6, the actuators 59*a*, 59*b* angle downwardly and outwardly from their respective panels 43*a*, 43*b*. However, in another operative arrangement, the locations of the joint 61 and the pivot mount 63 are reversed as to a particular panel 43 and the actuators 59 extend downwardly or downwardly and inwardly therefrom.

The invention recognizes the desirability of changing the operation of the bag unloading machine 10 as a function of the degree to which the bag 11 is emptied (or, depending upon one's viewpoint, the degree to which the bag 11 is filled). The specific process parameter that could be monitored to indicate such degree include gross weight (i.e., the combined weight of the bag 11 and the material 16 in it), the amount of bag "bulge" or bag compressibility. A highly preferred embodiment uses the latter parameter. (It is to be recognized that gross bag weight, bag bulge and bag compressibility all change as the weight of the material 16 in the bag 11 diminishes.)

Figure 10:
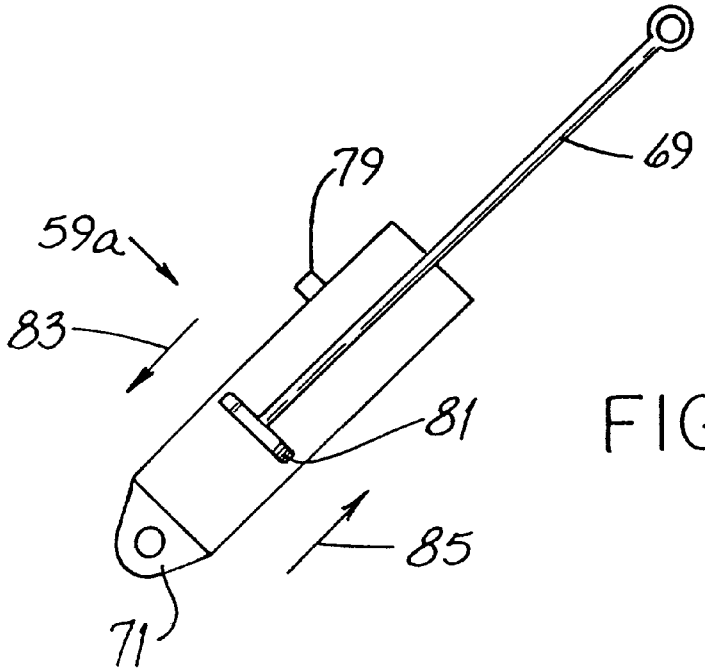
FIG. 10 is a representative sectional view of a panel actuator with the actuator rod in a partially extended position.
Figure 13:
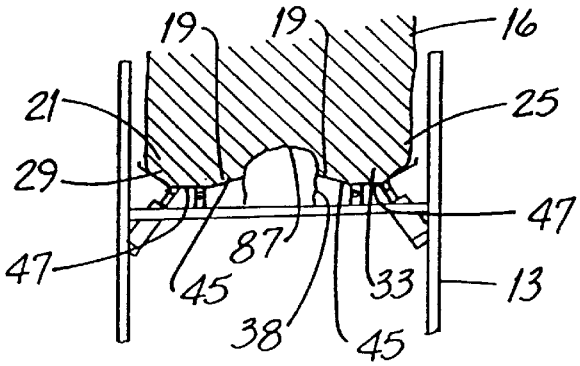
Figure 14:
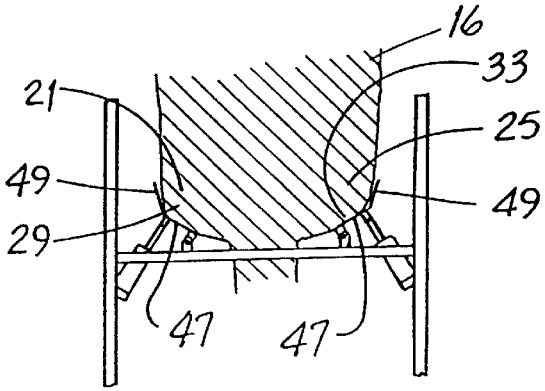
Figure 15:
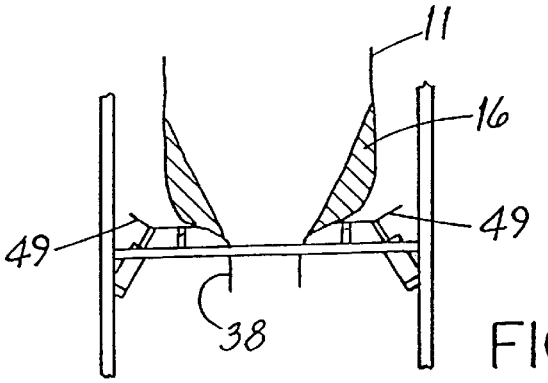
Figure 16:
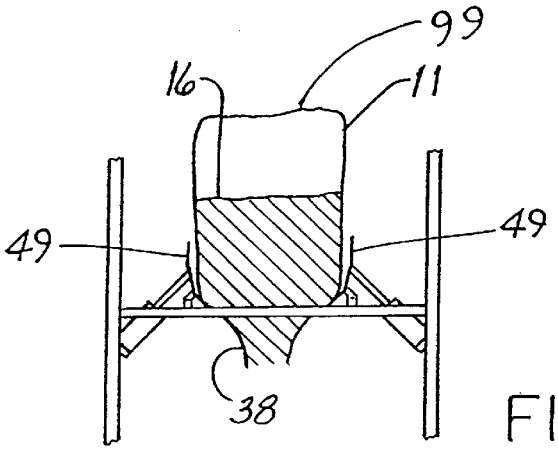

Referring now to FIGS. 1 through 12, the controller 17 is indirectly coupled to the actuator 59*a* (through an air valve 73 electrically connected to the controller 17 and pneumatically connected to a pressurized air source 75 and to the actuator 59*a*) and regulates actuator movement. A position sensor 79 is mounted on the actuator 59*a* and magnetically detects when the piston head 81 is in registry therewith. The air source 75 is regulated at a predetermined (but resettable) pressure which is more than adequate to retract the head 81 toward the actuator head end 71 as represented by the arrow 83. When a full bag 11 is on the frame 13, such pressure is insufficient to extend the rod 69 (in the direction of the arrow 85) to a position at which the head 81 is detected by the sensor 79. Such condition is represented by FIG. 10. In consequence, the first and second segments 45, 47 of each panel 43*a*, 43*b* alternately bear against the bottom portion 19 and the transition portions 29, 33 of the bag 11 to help eliminate a bridge 87 above the spout 38 as shown in FIG. 13. During this part of the emptying cycle, there is little if any tendency of the third segments 49 to bear against the side portions 21, 25 of the bag 11. The sequence of FIGS. 14, 15 and 16 represents the effectiveness of the machine 10 and, particularly, of the panels 43*a*, 43*b* in emptying material 16 from the bag 11 while yet substantially avoiding material bridging.

Figure 11:
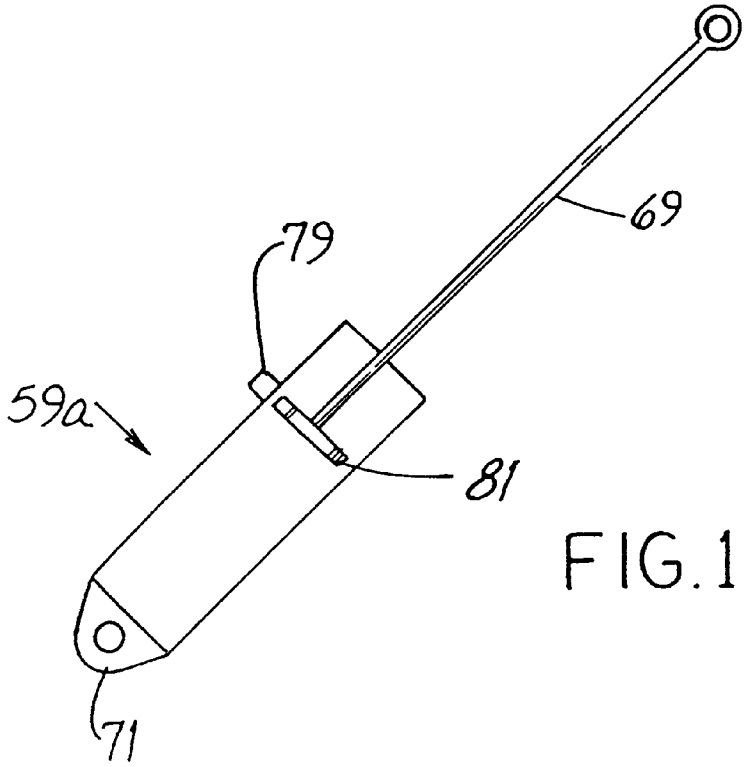
FIG. 11 is a representative sectional view of a panel actuator with the actuator rod in a more fully extended position.
Figure 12:
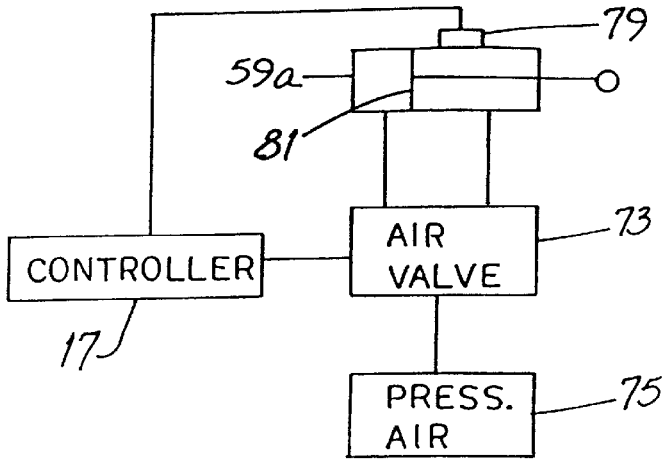
FIG. 12 is a representation of one embodiment of a controller/pneumatic circuit which may be used with the machine of FIG. 1.

As the bag 11 empties, it becomes more inwardly compressible and, at some degree of bag "emptiness," the predetermined pressure is sufficient to extend the rod 69 to a position at which the head 81 is detected by the sensor 79. This condition is represented by FIG. 11. And when the rod 69 moves to such position, the second and third segments 47, 49 of each panel 43*a*, 43*b* alternately bear against the transition portions 29, 33 and the side portions 21, 25 to help urge the material 16 out of the bag transition portions 29, 33 and away from the bag side portions 21, 25 as represented by the sequence of FIGS. 15 and 16.

In a specific embodiment, the controller 17 controls the valve 73 in such a way that until the sensor 79 detects the head 81, the rod 69 is urged in the retraction direction for a relatively long period of time and in the extension direction for a substantially shorter period of time. And when the sensor 79 detects the head 81 (which is an indication that the bag 11 has become more compressible because the amount and weight of the material 16 in it has significantly diminished), the rod 69 is urged in the extension direction for a relatively long period of time and in the retraction direction for a substantially shorter period of time.

For a specific relatively non-compressible material (i.e., one having low bulk density) such as rice hulls, and for a particular pressure in the source 75, about 75% of the contents of the bag 11 empty therefrom before the bag 11 becomes sufficiently compressible to permit the rod 69 to extend to a position at which the head 81 advances sufficiently far to be detected by the sensor 79. But, of course, the degree of bag emptiness at which the rod cycle is changed as described above can vary widely, depending upon the type of material 16 and depending upon the positions of the sensors 79 which are movable on the actuators 59*a*, 59*b*.

In a specific embodiment and for a particular material 16, the rods 69 move in unison and the sensors 79 are similarly positioned. However, that need not be the case. The machine 10 and its controller 17 can be configured to move the rods 69 alternately or randomly. And the sensors 79 can be placed at differing positions along their respective actuators 59*a*, 59*b*.

In a unique way, another aspect of the invention recognizes and deals with the propensity of powdered material 16 to lodge at the lower parts of the side portions 21, 25, and at the transition portions 29, 33 when the bag 11 is nearly, but not entirely, empty. Referring particularly FIGS. 1, 17 and 18, the machine 10 includes a bag lifting mechanism 89 positioned above the bag 11 and the tri-section panels 43*a*, 43*b*. The mechanism 89 and the bag 11 are connected to one another by hooks 91 from which the bag 11 is suspended. The bag lifting mechanism 89 includes an extensible device 93 such as an exemplary air bladder 93*a*. In a specific embodiment, the device 93 includes three air bladders 93*a* positioned and configured to apply lifting force to the bag 11 when pressurized air is forced into such bladders 93*a*. In a preferred embodiment, the extensible device(s) 93 coact between the frame 13 and the mechanism upper support 95.

It is preferred to use some sort of guide structure, e.g., telescoping tubes, relatively slidable channels or the like, between the frame 13 and the lifting mechanism 89. However, care must be taken to avoid "cocking" the lifting mechanism 89 with respect to the frame 13 and causing a guide structure to bind or lock up. To that end, it is highly preferred to use three air bladders 93*a* rather than four or more since three bladders 93*a* define a plane of support 97 but dramatically reduce the opportunity for guide binding.

Referring also to FIG. 19, in a specific way to use the mechanism 89, the controller 17 introduces pressurized air from an air source 75 (set at a fixed pressure) through a valve 73 and into the bladders 93*a* at a pressure insufficient to raise the mechanism 89 upwardly away from the frame 13 when the bag 11 is more than 10–20% full, as an example. Such pressure is also selected to raise the mechanism 89 and bag 11 and "tension" the bag 11 when the bag 11 becomes less than the exemplary 10–20% full. As represented by FIG. 15, when the bag top portion 99 is raised, the side portions 21, 23, 25, 27 and the transition portions 29, 31, 33, 35 move toward one another and the bag 11 becomes more elongate. This tends to spill the material 16 out of the portions 29, 31, 33, 35 and toward the spout 38. In this approach, bladder pressure is selected in view of bag and material weight but is not manipulated during the course of bag emptying.

Merely as an example of the foregoing operation, it is assumed that a bag 11 weighs 100 pounds, the material 16 in a filled bag weighs 2000 pounds and when the bag contents diminish to 20% bag fullness, the material remaining in the bag weighs 400 pounds. The pressure in the bladders 93*a* is selected to be able to urge the mechanism 89 and bag top portion 99 upwardly when the combined weight of the bag 11 and the remainder of the material 16 therein weight about 500 pounds (100 pound bag weight plus 400 pound material weight).

In another approach represented by FIG. 20, the controller 17 is coupled indirectly to the bladders 93*a* through an electrically adjustable pressure regulator 101. Pressure regulator 101 is directly coupled between a source 75 of pressurized air and an air valve 73. Air valve 73 and bladders 93*a* are connected in parallel. In this arrangement, bladder pressure can be easily selected as a function of the material 16 in the bag 11 and/or can be readily changed (by the programmed controller 17) as bag emptying progresses. (It should be apparent that the pressure in the source 75 should be at least equal to the maximum anticipated pressure required to be used in the bladders 93*a*.)

Referring to FIGS. 1–21, other aspects of the invention involve a method for unloading a bag 11 containing bulk material 16 and having the spout 38, and the bottom portion 19, side portions 21, 23, 25, 27 and transition portions 29, 31, 33, 35 mentioned above. The method includes providing a machine 10 having a movable tri-section panel 43 with first, second and third segments 45, 47, 49 and suspending the bag 11 so that its bottom portion 19, its transition portions 29, 31, 33, 35 and its side portions 21, 23, 25, 27 are proximate the first, second and third segments 45, 47, 49 respectively. The spout 38 is opened to permit material 16 to flow out of the bag 11 and, sequentially, the first and second segments 45, 47 are urged against the bottom portion 19 and the transition portions 29, 33, respectively. This helps prevent bridging at the onset of material flow from a full bag 11.

More specifically, the first segment 45 includes an inward edge 67 toward the spout 38 and a junction 51 proximate the second segment 47 and spaced from the inward edge 67. The urging step includes moving the tri-section panel 43 so that the inward edge 67 is above the junction 51 as shown in FIG. 21. In a preferred embodiment wherein the first segment 45 is substantially planar, the urging step includes moving the tri-section panel 43 so that the included angle A3 between the first segment 45 and a horizontal plane 103 is in the range of 1° to 6° and, most preferably, is about 3°. This feature is a useful departure from known approaches in that it "pushes up" significantly on the bottom portion 19 of the bag 11 to discourage bridging.

And as noted previously, the invention enables controlling the machine 10 and carrying out the method by monitoring a process parameter relating to the amount of material 16 remaining in the bag 11. When the amount of material 16 remaining in the bag 11 becomes about equal to some predetermined amount, the method involves pushing against the transition portions 29, 33 and the side portions 21, 25 using the second and third segments 47, 49 sequentially. More particularly, the pushing step includes changing the operation of the actuators 59*a*, 59*b*.

And changing the way the tri-section panel 43 pushes against the bag 11 is not the only event resulting from monitoring a process parameter. The method may also include elongating the bag 11 when the amount of material 16 remaining in the bag 11 becomes about equal to a predetermined amount. Bag elongation is by the bag lifting mechanism 89 and includes actuating the extensible device 93 as a function of bag compressibility.

The embodiment of the tri-section panels 43*a*, 43*b* shown in FIGS. 5–8 and is preferred. However (and referring to FIGS. 22 and 23), other embodiments of the tri-section panel are useful.

In the embodiment shown in FIG. 22, the second segment is planar and the first and third segments 45, 49 are curved. More specifically, such segments 45, 49 are curved at differing radii of curvature. As an example, the radius of curvature of the first segment 45 is greater than the radius of curvature of the third segment 49. (It is to be appreciated that three curved segments 45, 47, 49 having the same or differing radii of curvature could be used.)

The embodiment of the panel 43 shown in FIG. 23 includes a hinge joint 105 connecting the first and second segments 45, 47. Such panel 43 also includes one or a plurality of fingers 107 extending rigidly from the segment 47 to a location beneath the segment 45. During that initial part of bag emptying represented by FIGS. 13 and 14, the segments 45, 47 move in unison or tend to as the fingers 107 urge the segment 45 upwardly. As the bag 11 becomes more nearly emptied and the panel 43 moves toward and to the position shown in FIG. 5, the segment 45 is stationary or tends to be so and the second and third segments 47, 49 move in unison independently of the "inactive" segment 45 which remains substantially stationary.

As used herein, the terms "powder," "powder material" and "powdered material" and like terms mean a dry material 16 in powder form, e.g., talc or cement, as well as a dry material in small granule form.

While the principles of the invention have been shown and described in connection with preferred embodiments, it is to be understood clearly that such embodiments are by way of example and are not limiting.

What is claimed is:

1. In a machine for unloading a bulk-material bag having a bottom portion, a side portion and a transition portion between the bottom and side portions, the bag bottom portion extending along a generally horizontal plane when the bag is full, or nearly full, of bulk-material, the machine including at least one apparatus aiding discharge of the material from the bag, the improvement wherein:

the apparatus includes a tri-section panel mounted for movement on the machine at a pivot mount, the tri-section panel having:

at least first, second and third segments, each segment having a surface portion for contacting the bag;

an outward edge;

an inward edge; and the pivot mount is coupled to the panel at a location between the inward and outward edges and laterally spaced from the inward edge; and the tri-section Panel is movable back and forth between a first position in which the inward edge projects upwardly beyond the generally horizontal plane and into contact with the bag bottom surface and a second position in which the inward edge is positioned below the generally horizontal plane.

2. The machine of claim 1 wherein:

the first and second segments are angle-mounted to one another; and the second and third segments are angle-mounted to one another.

3. The machine of claim 2 wherein at least two of the first, second and third segments are substantially planar.

4. The machine of claim 1 wherein the tri-section panel further includes an actuator coupled thereto at an actuator joint at a location laterally spaced from the pivot mount.

5. The machine of claim 4 including a controller coupled to the actuator and regulating the movement thereof and wherein:

the controller regulates actuator movement as a function of the compressibility of the material contained in the bag.

6. The machine of claim 1 further including a bag lifting mechanism positioned above the tri-section panel, and wherein:

the bag lifting mechanism includes an extensible device; and the controller is coupled to the extensible device and regulates extension thereof as a function of bag compressibility.

7. The machine of claim 5 further including a frame and a bag lifting mechanism mounted with respect to the frame and positioned above the tri-section panel, and wherein:

the bag lifting mechanism includes an extensible device coacting between the frame and the mechanism.

8. The machine of claim 1 wherein the tri-section panel is a first tri-section panel, the side and transition portions of the bag are first side and first transition portions, respectively, and wherein:

the bag includes a second side portion and a second transition portion opposite the first side portion and the first transition portion, respectively; and wherein:

the machine includes a second tri-section panel mounted for movement at a pivot mount on the machine, the second panel having:

at least first, second and third segments, each segment having a surface portion for contacting the bag;

an outward edge;

an inward edge; and the pivot mount is coupled to the panel at a location between the inward and outward edges and laterally spaced from the inward edge; and the second tri-section panel is movable back and forth between a first position in which the inward edge projects upwardly beyond the generally horizontal plane and into contact with the bag bottom surface and a second position in which the inward edge is positioned below the generally horizontal plane.

9. The machine of claim 8 wherein:

the first and second tri-section panels are coincident with a tri-panel axis; and the machine includes a pair of support paddles pivot-mounted to be coincident with a support paddle axis generally perpendicular to the tri-panel axis.

10. A method for unloading a bag containing bulk material and having a spout, a bottom portion, a side portion and a transition portion between the bottom and side portions, the bag bottom portion extending along a generally horizontal plane when the bag is full, or nearly full, of bulk-material, the method including:

providing a machine having at least one movable tri-section panel with at least first, second and third segments and an inward edge;

suspending the bag so that its bottom, transition and side portions are proximate the first, second and third segments, respectively and so that the inward edge is proximate the bag bottom portion and the spout;

opening the spout; and after the step of suspending the bag, moving each panel back and forth between a first position in which the panel inward edge projects upwardly beyond the generally horizontal plane and into contact with the bag bottom surface proximate the spout and a second position in which the panel inward edge is positioned below the generally horizontal plane.

11. The method of claim 10 wherein the inward edge is along the first segment toward the spout and the first segment includes a junction portion proximate the second segment and spaced from the inward edge and wherein:

the moving step includes moving the tri-section panel so that the inward edge is above the junction portion.

12. The method of claim 10 wherein the first segment is substantially planar and the urging step includes moving the tri-section panel so that the included angle between the first segment and a horizontal plane is at least 1°.

13. The method of claim 10 including:

monitoring a process parameter relating to bag compressibility; and pushing against the transition portion and the side portion using the second and third segments sequentially when the bag compressibility increases to a predetermined level.

14. The method of claim 13 wherein the pushing step includes changing the operation of an actuator.

15. The method of claim 10 including:

monitoring a process parameter relating to the amount of material remaining in the bag; and elongating the bag when the amount of material remaining in the bag becomes about equal to a predetermined amount.

16. The method of claim 15 wherein the machine includes a bag lifting mechanism positioned above the tri-section panel and having an extensible device, and:

the elongating step includes actuating the extensible device.

17. The method of claim 16 wherein the extensible device includes an air bladder containing compressed air at a predetermined pressure.

18. In a machine for unloading a bulk-material bag, the bag having at least bottom and side portions and a spout, the bag bottom portion extending along a generally horizontal plane when the bag is full, or nearly full, of bulk-material, the machine including at least one apparatus aiding discharge of the material from the bag through the spout, the improvement wherein:

the apparatus includes at least a pair of bag-agitating implements, each implement having at least inward and outer spaced apart bag-contact portions and an inward edge along the inward bag-contact portion, each bag-agitating implement being mounted for reciprocating movement on the machine back and forth between a first position in which the inward edge is urged upwardly beyond the generally horizontal plane and into the bag bottom surface proximate the spout and a second position in which the inward edge is positioned below the generally horizontal plane.

19. The machine of claim 18 wherein the reciprocating inward edge reciprocates through an arc.

20. The machine of claim 18 wherein the implements are bag-agitating panels, the machine further comprising;

a plurality of segments formed in each panel, the segments configured and arranged so that each panel may be moved to contact the bag bottom, and at least one bag side portion; and each panel is mounted to the machine at a pivot mount, the pivot mount coupled to each panel at a location laterally spaced from the inward edge;

thereby configuring each panel inward edge to at least contact the bag bottom proximate the spout and each panel to contact at least one bag side portion.

21. The machine of claim 20 wherein the bag has a transition portion between the bottom and side portions and the panel segments are configured and arranged so that each panel may be moved to contact the bag bottom, and at least one bag side and transition portion.

22. The machine of claim 20 wherein each panel further includes at least one actuator coupled to each panel, each actuator provided for moving the panel.

23. The machine of claim 22 wherein the at least one actuator is coupled to the panel at an actuator joint laterally spaced from the pivot mount.

24. The machine of claim 23 further including a controller coupled to at least one actuator for regulating the actuator movement and wherein:

the controller regulates actuator movement as a function of the compressibility of the material contained in the bag.

25. A method for unloading a bag containing bulk material, the bag having a spout, a bottom portion, a side portion and a transition portion between the bottom and side portions, the method including:

providing a machine having a pair of movable panels, each panel having at least first, second and third segments, each segment for contacting the bag;

suspending the bag so that its bottom, transition and side portions are proximate the at least first, second and third segments, respectively;

determining the compressibility of the bulk material in the bag;

agitating at least the bag bottom portion when compressibility of the bulk material is below a predetermined value;

agitating at least the bag side portion when compressibility of the bulk material is above a predetermined value; and at any point after the suspending step, opening the spout to dispense bulk material from the bag.

26. The method of claim 25 wherein the step of agitating the bag bottom portion further includes the step of urging, sequentially, the first and second panel segments against the bottom portion and the transition portion, respectively of the bag.

27. The method of claim 26 wherein the step of agitating the bag side portion further includes the step of urging sequentially, the second and third segments against the transition portion and side portion, respectively of the bag.

28. The method of claim 25 wherein the step of determining the compressibility of the bulk material in the bag comprises continuously monitoring the compressibility of the bag as the bag is agitated.

29. The method of claim 25 including:

monitoring a process parameter relating to the amount of material remaining in the bag; and elongating the bag when the amount of material remaining in the bag becomes about equal to a predetermined amount.

30. The method of claim 29 wherein the machine includes a bag lifting mechanism positioned above the panels and having an extensible device, and;

the elongating step includes actuating the extensible device.

31. The method of claim 30 wherein the extensible device includes an air bladder containing compressed air at a predetermined pressure.

32. In a machine for unloading a bulk-material bag having a bottom portion, a side portion and a transition portion between the bottom and side portions, the machine including at least one apparatus aiding discharge of the material from the bag, the improvement wherein;

the apparatus includes:

a tri-section panel mounted for movement on the machine at a pivot mount, the tri-section panel having:

at least first, second and third segments, each segment having a surface portion for contacting the bag;

an inward edge; and the pivot mount is coupled to the panel at a location laterally spaced from the inward edge;

an actuator coupled to the panel at an actuator joint at a location laterally spaced from the pivot mount;

a controller coupled to the actuator for regulating actuator movement as a function of the compressibility of the material contained in the bag, the compressibility being determined by panel movement;

a sensor operatively connected to the controller positioned to detect movement of the tri-section panel toward the bag, the sensor providing the controller with at least one predetermined position of the panel; and the controller regulates actuator movement in response to movement of the tri-section panel to the at least one predetermined position.

33. The machine of claim 32 wherein:

the actuator comprises a cylinder and a piston positioned therein;

the sensor is positioned to detect movement of the piston in the cylinder; and the controller regulates actuator movement in response to movement of the piston to at least one predetermined position in the cylinder.

34. A method for unloading a bag containing bulk material, the bag having a spout, a bottom portion, a side portion and a transition portion between the bottom and side portions, the method including;

providing a machine having a movable tri-section panel with at least first, second and third segments;

suspending the bag so that its bottom, transition and side portions are proximate the first, second and third segments, respectively;

opening the spout; and urging, sequentially, the first and second segments against the bag bottom portion and the transition portion, respectively;

monitoring tri-section panel movement as a process parameter relating to bag compressibility, the parameter being movement of the tri-section panel;

sensing that the tri-section panel has moved to at least one predetermined position; and pushing against the transition portion and the side portion using the second and third segments sequentially once the tri-section panel has moved to the at least one predetermined position.

35. The method of claim 34 wherein the pushing step includes changing the operation of an actuator coupled to the tri-section panel at an actuator joint.

36. The method of claim 35 wherein the actuator comprises a cylinder and a piston positioned therein, and the sensing step comprises sensing that the piston has moved to at least one predetermined position in the cylinder and the pushing step comprises changing the operation of the actuator in response to movement of the piston to the at least one predetermined position in the cylinder.

37. In a machine for unloading a bulk-material bag, the bag having at least bottom and side portions and a spout, the machine including at least one apparatus aiding discharge of the material from the bag through the spout, the improvement wherein:

the apparatus includes:

at least a pair of bag-agitating panels mounted for movement at a pivot mount on the machine, each panel having:

a plurality of segments formed in each panel, the segments configured and arranged so that each panel may be moved to contact the bag bottom, and at least one bag side portion; and an inward edge along each panel positioned to push up against the bag bottom portion; and the pivot mount is coupled to each panel at a location laterally spaced from the inward edge;

at least one actuator coupled to each panel at an actuator joint laterally spaced from the pivot mount for moving the panel;

a controller coupled to at least one actuator for regulating the actuator movement as a function of the compressibility of the material contained in the bag, the compressibility being determined by panel movement;

a sensor operatively connected to the controller and positioned to detect movement of at least one panel toward the bag, the sensor providing the controller with at least one predetermined position of at least one panel; and the controller regulates actuator movement in response to movement of at least one panel to the at least one predetermined position.

38. The machine of claim 37 wherein:

each actuator comprises a cylinder and a piston movably positioned therein;

the sensor is positioned to detect movement of at least one piston; and the controller regulates actuator movement in response to movement of the at least one piston to at least one predetermined position.

39. In a machine for unloading a bulk-material bag, the bag having at least bottom and side portions and a spout, the bag bottom portion extending along a generally horizontal plane when the bag is full, or nearly full, of bulk-material, the machine including at least one apparatus aiding discharge of the material from the bag through the spout, the improvement wherein:

the apparatus includes:

at least a pair of bag-agitating implements, each implement having at least inward and outer spaced apart bag-contact portions and an inward edge along the inward bag-contact portion, each bag-agitating implement being mounted for reciprocating movement on the machine back and forth between a first position in which the inward edge is urged upwardly beyond the generally horizontal plane and into the bag bottom surface proximate the spout and a second position in which the inward edge is positioned below the generally horizontal plane, an actuator coupled to each implement and to the machine;

a controller coupled to at least one actuator for regulating actuator movement;

a sensor operatively connected to the controller positioned to detect movement of at least one implement as the inward portion is moved into back and forth contact with the bag, the sensor providing the controller with at least one predetermined position of the implement; and the controller regulates actuator movement in response to movement of the tri-section panel to the at least one predetermined position changing implement movement so that each implement outer portion is moved back and forth between a third position in which the outer portion is urged into contact with at least a bag side portion and a fourth position in which the outer portion is positioned away from the side surface.

40. The machine of claim 39 wherein:

the actuator comprises a cylinder and a piston positioned therein;

the sensor is positioned to detect movement of the piston in the cylinder; and the controller regulates actuator movement in response to movement of the piston to at least one predetermined position in the cylinder.

* * * * *

UNITED STATES PATENT AND TRADEMARK OFFICE

CERTIFICATE OF CORRECTION

PATENT NO. : 6,186,360
DATED : February 13, 2001
INVENTOR(S) : Steven L. Becker, Thomas G. Kelly and Jeffery M. Nauman It is certified that error appears in the above-identified patent and that said Letters Patent is hereby corrected as shown below:

At column 10, line 28, change "Panel" --to panel--.

Signed and Sealed this

Fifth Day of June, 2001

Nicholas P. Godici

NICHOLAS P. GODICI

*Acting Director of the United States Patent and Trademark Office*

*Attest:*

*Attesting Officer*